US008726993B2

(12) United States Patent
Cooke, Jr.

(10) Patent No.: US 8,726,993 B2
(45) **Date of Patent: *May 20, 2014**

(54) METHOD AND APPARATUS FOR MAINTAINING PRESSURE IN WELL CEMENTING DURING CURING

(76) Inventor: Claude E Cooke, Jr., Montgomery, TX (US)

( * ) Notice: Subject to any disclaimer, the term of this patent is extended or adjusted under 35 U.S.C. 154(b) by 234 days.

This patent is subject to a terminal disclaimer.

(21) Appl. No.: 13/115,502

(22) Filed: May 25, 2011

(65) Prior Publication Data

US 2011/0290485 A1 Dec. 1, 2011

Related U.S. Application Data

(60) Provisional application No. 61/349,092, filed on May 27, 2010, provisional application No. 61/412,671, filed on Nov. 11, 2010.

(51) Int. Cl.
*E21B 33/13* (2006.01)
*E21B 43/00* (2006.01)

(52) U.S. Cl.
USPC ..... 166/286; 166/177.4; 166/177.6

(58) Field of Classification Search
USPC ..... 166/286, 177.4, 177.6
See application file for complete search history.

(56) References Cited

U.S. PATENT DOCUMENTS

| | | | | |
|---|---|---|---|---|
| 3,335,801 A | | 8/1967 | Wilsey | |
| 4,407,365 A | * | 10/1983 | Cooke, Jr. | 166/249 |
| 5,152,342 A | * | 10/1992 | Rankin et al. | 166/286 |
| 5,361,837 A | | 11/1994 | Winbow | |
| 5,377,753 A | | 1/1995 | Haberman et al. | |
| 5,439,290 A | * | 8/1995 | Wicks et al. | 366/241 |
| 6,725,923 B1 | | 4/2004 | Ivannikov et al. | |
| 7,311,143 B2 | * | 12/2007 | Engels et al. | 166/254.2 |
| 2009/0159282 A1 | | 6/2009 | Webb et al. | |

FOREIGN PATENT DOCUMENTS

WO 2004/073929 9/2004

OTHER PUBLICATIONS

"Field Measurements of Annular Pressure and Temperature During Primary Cementing," J. Pet. Tech., Aug. 1983.
"Primary Cementing Improvement by Casing Vibration During Cement Curing Time," SPE Production Engineering, Aug. 1988.
"The Rheological Properties of Cement Slurries: Effects of Vibration, Hydration Conditions, and Additives" SPE Production Engineering, Nov. 1988.
"Cement Shrinkage Measurement in Oilwell Cementing—A Comparative Study of Laboratory Methods and Procedures," SPE Drilling and Completion, Mar. 2009.
"New Model of Pressure Reduction to Annulus During Primary Cementing," IADC/SPE 59137, Feb. 2000.
"Downhole Impulses vs. Downhole Impacts Improve Recovery of Stuck Retrievable Packers," 2004.
United States Patent and Trademark Office, Office Action Summary for U.S. Appl. No. 13/293,770, mailing date of Jul. 18, 2013; p. 1-41.

* cited by examiner

*Primary Examiner* — William P Neuder
(74) *Attorney, Agent, or Firm* — John J. Love; Cooke Law Firm

(57) ABSTRACT

Method and apparatus are provided for cementing wells and preventing fluid entry into the wellbore before the cement cures and increasing radial stress in the cured cement. Impacts or vibrations are applied to the casing during the time that the cement is curing. The source or sources of the impacts or vibration are placed in the casing during displacement of the cement slurry or soon after placement and are mechanically coupled to the inside wall of the casing. The sources may later be withdrawn from the casing or expendable sources may be used.

14 Claims, 4 Drawing Sheets

METHOD AND APPARATUS FOR MAINTAINING PRESSURE IN WELL CEMENTING DURING CURING

This application claims priority to provisional application Ser. No. 61/349,092 filed on May 27, 2010 and provisional application Ser. No. 61/412,671 filed on Nov. 11, 2010. These applications are hereby incorporated by reference in their entirety.

BACKGROUND OF INVENTION

1. Field of the Invention

This invention relates to cementing of casings in wells. More particularly, method and apparatus are provided for preventing entry of fluids from the surrounding rock into the cement before it cures and for attaining higher radial stress in the cured cement.

2. Background of the Invention

The phenomenon of annular fluid flow (called "annular gas flow" when gas comes to the surface) has long been known to occur during cementing of wells. It is caused by fluids from the surrounding rock entering the wellbore before the cement cures. The resulting loss of control of a well has been responsible for loss of life and property for many years. In addition to the well control issue, annular fluid flow of fluids between zones before the cement cures can cause lack of zonal isolation in wells; water flow to surface from shallow pressurized water sands may occur; and casing shoes may not test at expected pressure integrity. All such occurrences can be manifestations of shortcomings in the primary cementing process.

In 1983, Cooke et al described the results of measurements of pressure and temperature in a curing cement column in seven oil and gas wells ("Field Measurements of Annular Pressure and Temperature During Primary Cementing," *J. Pet. Tech.*, August 1983). In all the wells, pressure in the cement column began to fall as soon as pumping of the cement ended. The paper explains that the pressure falls because cement shrinks in volume during the curing process because of: (1) the hydration reaction and (2) fluid loss from the cement, and at the same time cement develops a gel strength that prevents the cement column moving downward to compensate for the loss in volume. The decrease in volume combined with the gel formation result in a reduction in pressure in the cement column. If this pressure in cement is reduced to a value below the pressure of a fluid in a permeable rock penetrated by the well before the cement has cured sufficiently, the fluid from the rock enters the cement. This is the phenomenon of "annular fluid flow." Measurements showed that the pressure in the cement column becomes the same as the pore pressure where fluid has entered. Other laboratory observations showed that fluid entering a cement column may rapidly channel up through the cement. This 1983 paper is hereby incorporated by reference herein for all purposes. Some of the field results reported in the paper were analyzed by Zhou et al (IADC/SPE 59137) using a mathematical model.

U.S. Pat. No. 4,407,365 discloses a method for preventing annular fluid flow—by periodically vibrating the casing while the cement is curing, to maintain pressure in the cement above fluid pressure in the pores of surrounding rock. The patent discloses several methods for vibrating the casing. One method is to ignite small explosives at different depths in the casing. The charges may be run on wire line and set off to cause a plurality of pressure pulses at different depths. The limitation of this method is that the amplitude of any vibrations caused outside the casing would be very small and of very limited extent along the axis of the casing. Another method disclosed is to lock a hydraulic jar attached to a drill string into a retaining groove in the casing and to repeatedly activate and re-set the jar during cement curing time. The limitation to this method is that it would be necessary to run a pipe in the casing after cement is pumped, which would be expensive and time-consuming, and it would be difficult to apply a jarring force in more than one location along the casing. Other methods disclosed include using explosive to propel a projectile against the casing wall, using vibrators on electric wire line, driving vibrators by fluid flow down a pipe string inside casing and electrical or hydraulic hammers. There are at least two disadvantages to the use of vibration sources on a wireline or a pipe string: (1) the wireline or string cannot enter a casing until after cement is pumped, and then delivering the vibration sources to a plurality of preferred depths in the casing would be time-consuming and expensive; (2) the power available for a vibrator would be severely limited by the power transmission capabilities of a wireline. Similar limitations exist for use of explosive charges to propel a projectile against the casing wall. This patent is hereby incorporated by reference herein for all purposes.

Two technical articles that help to elucidate the requirements for a process to maintain pressure in a cement column by vibrating the casing are: (1) "Primary Cementing Improvement by Casing Vibration During Cement Curing Time," *SPE Production Engineering*, August 1988, and (2) "The Rheological Properties of Cement Slurries: Effects of Vibration, Hydration Conditions, and Additives" *SPE Production Engineering*, November 1988. The first article reports that axially vibrating a casing in a 200-ft well with a large electromagnetic vibrator attached to the top of the casing maintained pressure in the cement as it cured and also increased radial stress in the cement, resulting in a very good cement bond log. The increase in radial stress in the cement will increase the resistance to flow between the cement and the wellbore. During the vibration process the surface of the cement in the annulus dropped during each vibration period. The second article reported that breaking the gel structure of cement in a rheometer required only a small amplitude vibration, which was not sensitive to frequency, but that the structure began forming again in a very short time period after it was broken—in the range of 1 minute. Chemical additives in the cement affected gel strength during curing. These two articles are hereby incorporated by reference herein for all purposes.

FIGS. 1A and 1B illustrate why it is critically important in cementing some wells to minimize loss of pressure in the cement after it is pumped and before it cures. FIG. 1A illustrates well 10, which penetrates zones Z1 and Z2. Wellbore 11 has been formed, casing 12 has been placed in the wellbore and cement 13 has been pumped into the annulus outside the casing. The two characteristics of the strata penetrated by the well that are important for cementing are fracture gradient (the pressure gradient that will create a fracture in the earth) and pore pressure. Pressure that can exist in the cement slurry as it is pumped is limited by the fracture gradient in the earth, represented by line 14, on the right. The fracture gradient is represented as slightly less than normal in Zone 1, so this zone will limit pressure in the cement slurry. Cement slurry density and viscosity are selected such that the Equivalent Circulating Density (ECD—line 16) of the cement is less than fracture gradient throughout the cement column and static head is higher than pore pressure in any zone. Pore pressure is represented by line 18, on the left. Pore pressure is slightly higher than normal in Zone 2. In some wellbore conditions, the difference in pressure between highest allowable cement pressure and the highest pore pressure in a zone is small. Therefore, the allowable pressure drop in the cement column before cement pressure drops to pore pressure in a permeable zone may be, for example, only 200-300 psi. Consideration of the fact that cement pressure drops rapidly after pumping in some wells (August 1983 *J. Pet. Tech.* paper, referenced above) leads to the conclusion that a method to limit pressure drop in the cement after pumping that will keep pore fluids from entering the cement column should be available for application soon after cement-pumping ends. As the cement cures, gel strength increases, which means that breaking gel strength in the cement column, such that the cement will flow, will become more difficult as time-after-pumping increases. Maintaining pressure in the cement column will not only prevent fluid entry into the cement while it is curing, it will also cause flow of cement in a radial direction outward, leading to higher radial stress when the cement has cured.

Later references disclose other methods for vibrating casing during cement curing time. U.S. Pat. No. 5,361,837 discloses a method for preventing annular fluid flow using tube waves in the casing. The tube waves are induced in casing by pressure variations at the surface caused by opening and closing of valves to pump in and out a liquid. The patent discloses that studies showed that casing vibration having a longitudinal displacement of at least 0.25 inches along the wellbore axis is normally more than sufficient to break the gel strength of cement slurry around the region of vibration and that the tube waves can cause longitudinal displacement of about 1.0 to 1.5 inches at the bottom of a casing string. The disclosure posits that extensional waves near the bottom of the casing, in the region of the hydrocarbon zone, are sufficient to prevent annular fluid flow. No evidence is presented, however, that vibration only near the bottom of a casing string will allow the pressure in cement to increase near the bottom of the casing.

U.S. Pat. No. 5,152,342 discloses apparatus and method for vibrating a casing string during cementing, with the vibrating device located near the bottom of the casing string. Cement slurry being pumped down a casing flows through a device, powering the device and causing vibrations in the casing.

U.S. Pat. No. 6,725,923 discloses apparatus that includes hammers that oscillate in a radial direction and hit the wall of tubes when the flexible suspension to which the hammers are attached is pulled. It is stated that the resulting vibrations in the casing can improve cementing.

U.S. Pat. No. 5,377,753 discloses a method for breaking the gel strength of cement in an annulus by applying pressure pulses in a fluid above the annulus.

U.S. Patent Application Publication 2009/0159282 discloses inducing pressure pulses in the cement in the annulus before the cement has cured "for bonding a wellbore to a casing."

All prior art methods disclosed for inducing vibration into a casing to prevent pressure drop in the cement column have been limited by applying vibration only at the top end or the bottom end of the casing or, if vibration is induced at intermediate points along the casing, by placing apparatus in the casing after pumping of cement has ended (the top plug has been "bumped"). No method or apparatus is known for inducing vibrations into a casing string by sources mechanically coupled to the casing at locations spaced apart along the casing and inducing these vibrations "near simultaneously" (defined herein as within a time period before gel strength of the cement re-builds to its original value after it is broken by vibration), beginning soon after cement pumping ends. What is needed is method and apparatus for inducing an impulse or vibrations at a selected location or at selected locations along a casing string beginning soon after pumping of cement ends and continuing for a selected time during the cement curing period. ("Soon" depends on the time required for the cement to build gel strength to a selected value. For most cements, this time is preferably less than 30 minutes.)

BRIEF SUMMARY OF THE INVENTION

Apparatus and method are provided for pumping down and mechanically coupling to the casing a source or sources of impulses or vibrations that are activated by pressure changes in the casing and then retrieved or drilled or milled from the casing or moved to a segment of the casing that is not to be used in further well operations. Power for the source of the impulses may be supplied by fluid pressure changes in the casing resulting from alternately pumping in and releasing fluid from the casing. Sources for the impulse or vibration may be pumped to the locations along the casing string by launching them into the displacing fluid while cement is being displaced from the casing or dropping them after the plug has been bumped. The devices for applying impulses to the casing may be locked in place (mechanically coupled) in sections of the casing adapted for receiving the devices or may be locked by a locking mechanism in the device. In one embodiment, the source of an impulse may be a mechanical or hydraulic jar, such as that known in the industry. The jars may be activated by an increase in hydrostatic pressure in the casing. Potential energy stored in the jar may be derived from a pressure increase in the casing. Other sources of energy, such as chemical reactions may be used to induce the impulses or vibrations in the casing. Alternately, the devices may be vibrators driven by flow of fluid under pressure that is created by increase and decrease in pressure in the casing or from other sources. The devices in the casing are operated as the cement cures to maintain pressure in the cement above pore pressure in zones in contact with the cement for a selected time and to increase the radial stress in cured cement. After cement curing, the devices may be recovered to the surface, where they may be re-used, or they may be expendable devices that are removed by drilling or milling from the casing (casing above production casing) or they may be moved to a segment of the casing where they are not interfering with further operations in the well, such as a rathole (production casing).

BRIEF DESCRIPTION OF THE SEVERAL VIEWS OF THE DRAWING(S)

DETAILED DESCRIPTION OF THE INVENTION

Figure 2:
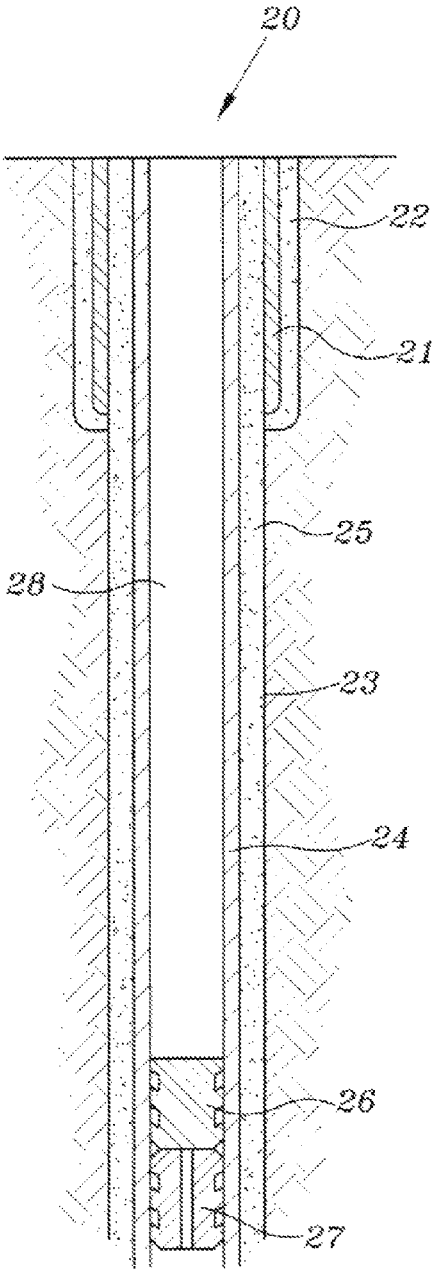
FIG. 2 PRIOR ART
FIG. 2 (prior art) illustrates a well with two casing strings cemented into the earth.

Referring to FIG. 2 (prior art), well 20 has been drilled by first drilling a hole and cementing casing 21 (conductor casing) with cement 22. A second smaller diameter hole 23 has been drilled out of the bottom of the conductor casing and casing string 24 ("surface casing") has been cemented in place using cement 25. The cementing operation is well known in the industry. It may involve launching a bottom plug 27 ahead of the cement, pumping the cement, breaking a diaphragm in the bottom plug and launching top plug 26 behind the cement and displacing it with displacement fluid 28 (normally brine or drilling fluid). Sufficient cement may be placed in the well to bring the top of cement back to the surface of the earth (as shown) or the top of the cement may be brought to some selected depth below the surface of the earth. The surface casing extends to a depth below the surface of the earth sufficient to protect all usable water zones. It is very important that the surface casing cement create a high resistance to flow outside the casing, to prevent fluids moving through the wellbore into usable water zones.

Figure 3:
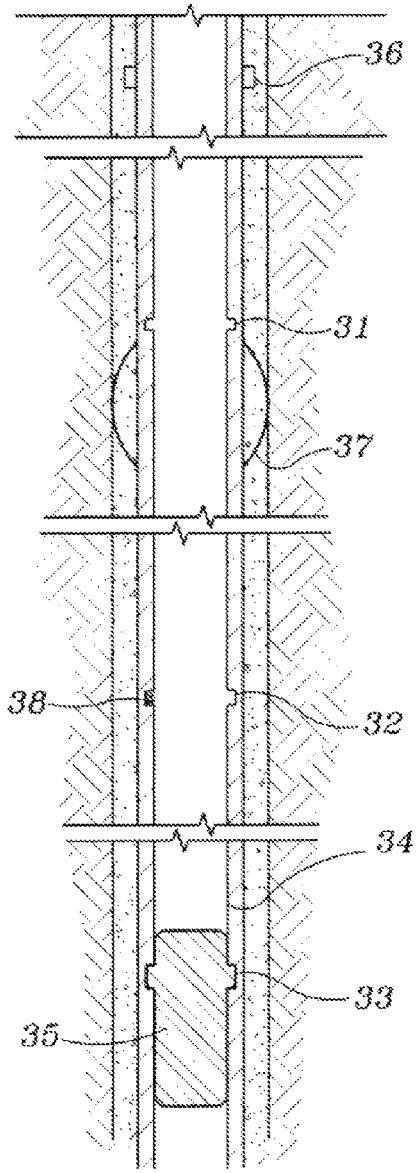
FIG. 3 illustrates a well with a casing string having receiving grooves for locking devices at selected locations along the casing string.

FIG. 3 illustrates casing 34 that includes receiving grooves 31, 32 and 33. Casing 34 may be a conductor pipe, a surface casing, an intermediate casing, a production casing, or it may be a liner in a well. All such tubulars will be referred to herein as "casing." The number of receiving grooves in the casing may be selected to be from one to twenty or more, depending on the length of the casing and predictions of the length of the interval along the casing around each impulse or vibration source in which gel strength will be broken by operation of a source such as source 35, shown in lowest groove 33. One or more rings, such as ring 36, may be clamped on the exterior of casing 34 to increase resistance to axial movement of casing 34 and couple greater amounts of vibration energy into the cement surrounding casing 34 near the rings. One or more casing centralizers, such as centralizer 37, may be attached to the casing. Receiving grooves may have grease 38 in the grooves when the casing is installed to prevent cement entering the grooves as it is pumped down the casing.

Figure 4:
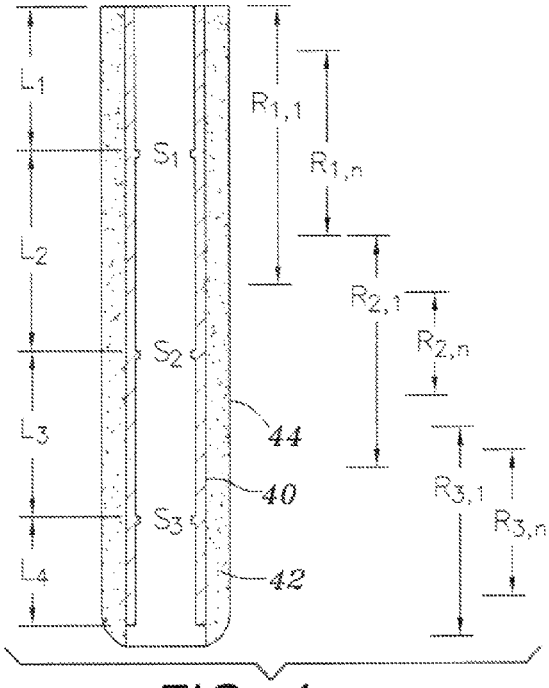
FIG. 4 illustrates how the number and placement of impulse or vibration sources may be selected for a casing string.

FIG. 4 illustrates how the placement and number of receiving grooves or sources of impact in casing 40 may be selected. The spacing of impact or vibration sources may be $L_1, L_2 \ldots L_n$. Each source, $S_1 \ldots S_n$, creates an impact or vibration that is transmitted through the casing over a range, R. The range of an impact or vibration from source $S_1$ will decrease from $R_{1,1}$ to $R_{1,n}$ (from the first activation to the last activation) as the cement in cement column 42 progresses through the curing process. Range (attenuation) will depend on the properties of the casing and the cement, the fluid loss into zones penetrated by hole 44 and the characteristics of the impact or vibration from source S. At the time of first activation, ranges of sources may overlap, as illustrated. Although not shown in FIG. 4, of course a source of impact or vibration may also be present at the surface, as discussed in the paper "Primary Cementing Improvement by Casing Vibration During Cement Curing Time," *SPE Production Engineering*, August 1988, incorporated above. The casing may be supported on a spring, as disclosed therein. Activation of the sources will preferably continue at least as long as the top of cement column 42 falls after activation or until a predicted time when impulses or vibration will no longer be effective or be needed. Activation of the sources may continue until any further predicted decrease in volume of the cement column up to the time the cement has set is less than a selected amount. In other words, impacts or vibration will preferably continue until enough of the shrinkage of the cement during curing has been compensated for, by allowing the cement to move axially and radially, such that further shrinkage during curing will have minimal effect. The rate of shrinkage of cement and its variations during cement curing are discussed, for example, in the paper "Cement-Shrinkage Measurement in Oilwell Cementing—A Comparative Study of Laboratory Methods and Procedures," *SPE Drilling and Completion*, March 2009, which is hereby incorporated by reference herein for all purposes. A mathematical model that considers all the variables that determine pressure loss in the cement column, such as the model described by Zhou et al, ("New Model of Pressure Reduction to Annulus During Primary Cementing," IADC/SPE 59137, February 2000) may be used to select the time for applying impacts or vibration to the casing. This paper is hereby incorporated by reference for all purposes. Such a model may also be used to select placement of the sources or to concentrate vibrations in a part of the borehole where low pore pressures may have caused high fluid loss and gel strength, for example.

The damping of amplitude of an impact or vibration from a source may be predicted using finite element analysis and rheology data providing wellbore viscoelastic properties of the cement at wellbore conditions as a function of time after pumping and time after breaking the gel. (Such properties for a cement at room temperature are provided in the SPE Production Engineering article of November 1988, referenced above.) Shrinkage data for the wellbore cement vs time may be obtained as discussed in the March 2009 article referenced above. Impact data for a jar or other source may be available from the manufacturer or may be measured for the conditions of use. Strain gage measurements of the amplitude of casing displacement and measurements of pressure in the cement may be used to calibrate predictions of amplitude and determine how the amplitude of casing displacement affects pressure in the cement. One model of the cementing process (without vibrations or impulses) after pumping, such as may be used to predict pressure after pumping has ended was published by Zhou et al ("New Model of Pressure Reduction to Annulus During Primary Cementing," IADC/SPE 59137, February 2000, referenced above). Segments of the cement column where gel strength is not broken by impacts or vibration may be caused to move because gel strength is broken in other segments of the cement column, resulting in higher pressure gradient along the cement column where gel strength is not broken. Pressure gradient along the cement column may also be increased by application of a pressure at the surface of the annulus during cement curing, a practice that has long been known in industry, in combination with the methods taught herein. Such surface pressure is limited by fracture gradients in the earth, which usually make this approach ineffective when used alone. A pressure gauge in the fluid above the cement in an annulus may be monitored to detect movement of the top of the cement column when the casing is vibrated. Preferably the gage and connections are liquid-filled. The compressibility of the gauge system (pressure change per volume change) may be used to indicate the volume of shrinkage of cement compensated for by vibration of the casing.

Figure 5:
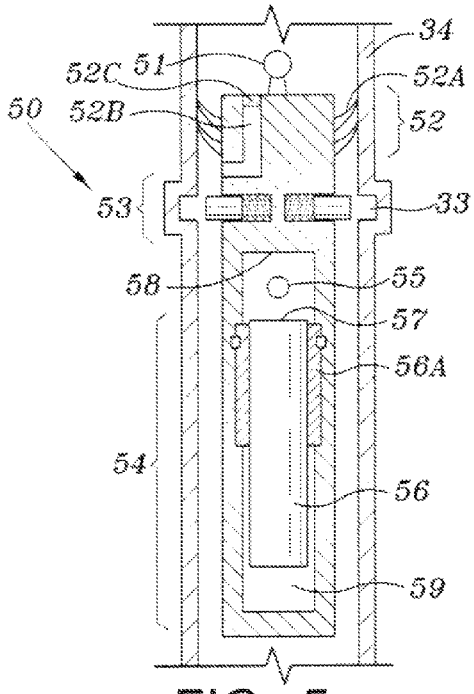
FIG. 5 illustrates a device that may be pumped down casing, used to apply impulses to the casing when locked into receiving grooves of a casing, and retrieved from the casing after use.

FIG. 5 shows one embodiment of device 50, which is designed to be pumped down the casing to a receiving groove, latched into a selected groove, energized by pressure changes in the casing to impart an impulse to casing when activated, and retrieved after use. Device 50 may be pumped down using rubber cups 52A in placement section 52. Alternatively, placement section 52 may not be present. Locking dogs in locking section 53 are spring loaded to slide on the inside surface of casing and slip into a receiving groove adapted to receive the locking dog, such as groove 33. The locking dogs may have a width greater than all receiving grooves above the groove into which they are to be locked, so that they will not enter, but will ride over, the higher receiving grooves until they reach the intended groove. Other selective locking mechanisms known in the downhole tool industry may be used in locking section 53. When locking dogs slip into receiving grooves, continued pumping ruptures disc 52C in by-pass 52B of placement section 52, allowing a pressure pulse at the surface to confirm latching of device 50 in casing 34 and allowing continued pumping of displacement fluid to complete cement slurry displacement.

Figure 1A:
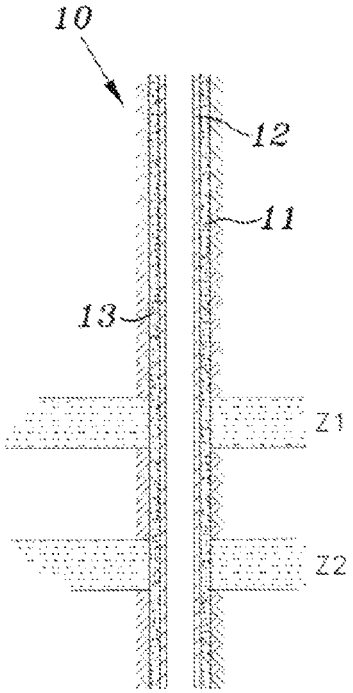
FIG. 1A illustrates a well penetrating two zones in the earth.
Figure 1B:
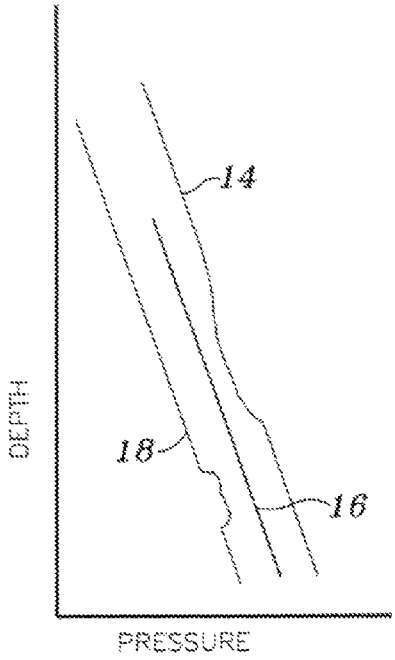
FIG. 1B illustrates fracturing gradient in the earth, pressures in a cement slurry in the well and pore pressure in the two zones penetrated by the well.
Figure 8:
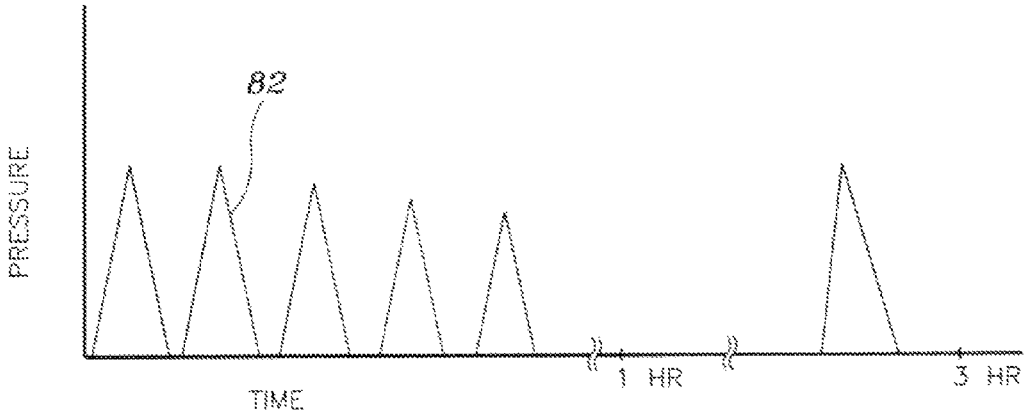
FIG. 8 illustrates pressure changes in casing used to activate an impulse source during the cement curing time.

Impulse source 54 may employ a mechanical or hydraulic jar, which is well known in industry. The jar is energized by pressure increases and decreases in fluid pressure 82 outside the source, as illustrated in FIG. 8. As pressure increases in the casing, carriage 56A is moved downward by hydraulic pressure, transmitted through port 55, and is locked to mandrel 56 by a mechanism that releases mandrel 56 when a selected position of the carriage is reached. As mandrel 56 moves downward, energy is stored in chamber 59, either by a spring or by fluid pressure, or both. When mandrel 56 is released, mandrel 56 strikes anvil 58, imparting an impulse to a casing string mechanically coupled to locking dogs 53. Re-setting springs (not shown) then return carriage 56A to its initial position, where it re-locks into mandrel 56. The jarring action can be repeated in short time intervals for a selected time. Fishing neck 51, which operates under an upward pull to retract locking dogs 53 from a receiving groove, may also retract cups 52A and open additional ports to minimize swabbing action, and can then be used to remove source 50 from the casing. The fluid pressure in port 55 that will operate to release mandrel 56 from carriage 56A is determined by the pre-set pressure or spring force in chamber 59. The fluid pressure or spring force in chamber 59 for each impulse source in a casing will preferably be set at a value to compensate for differences of depth in a well where it will be mechanically coupled to the casing, when multiple sources are in a casing, such that an increase of pressure at the surface of the casing will operate all impulse sources in the at about the same time, or near simultaneously, as that term is defined above. Materials used to form apparatus 50 may be selected to allow apparatus or parts of apparatus 50 to be drilled or milled from the casing or released such that it can be moved to a location that will not interfere with further operations in the well or can be drilled into small pieces.

Figure 6:
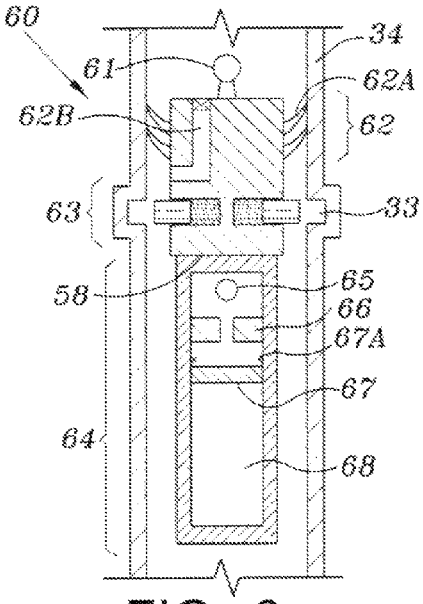
FIG. 6 illustrates a device that may be pumped down casing, used to apply vibrations to the casing when locked into the receiving grooves of the casing, and retrieved from the casing after use.

FIG. 6 illustrates device 60 that may be pumped down casing, used to apply vibrations to the casing when locked into the receiving grooves of the casing, and retrieved from the casing after use. Device 60 may be pumped down using rubber cups 62A. Alternatively, rubber cups 62A may not be present. Locking dogs 63 are spring loaded to slide on the inside surface of casing and slip into a receiving groove adapted to receive the locking dogs. Locking dogs 63 may have a width greater than all receiving grooves above the groove into which they are to be locked, so that they will not enter, but will ride over, the higher receiving grooves until they reach the intended groove. Rubber cups 62A and by-pass 62B function as described above.

Vibration source 66 may be an oscillating, vibrating or rotating vibrator driven by flow of fluid. Such vibrators are well known in industry. For example, a tool described in SPE 90737, "Downhole Impulses vs Downhole Impacts Improve Recovery of Stuck Retrievable Packers," 2004, may be used. This paper is incorporated by reference herein for all purposes. Another source of vibration (vibrator) may be a water hammer, such as used in impact drilling. Such hammers are available, for example, from Wassara AB of Stockholm Sweden. A Model W 80 Wassara hammer will produce vibrations at a frequency of 65 Hz and 210 Joule/blow with a flow rate of about 32 gal/min through the hammer, according to the manufacturer. Thus, five seconds of vibration may be produced by flow of about 2.7 gallons of water through the hammer and into an accumulator. Such hammers may be designed to produce different frequencies of vibration at selected flow rates through the hammer. Optimum frequency ranges may be selected by comparing results of vibration at various frequencies. (The impact surface of jars or hammers may have lower modulus materials to cause more low-frequency output of energy.) Pressure port 65 transmits fluid from the casing through vibrator 66 to compress gas in chamber 68 by moving piston 67 (a hydraulic piston accumulator). Alternatively, a spring accumulator may be used to receive water driven through a hammer. Accumulators are readily available from many sources in industry. A detent mechanism in the accumulator may be used to prevent flow into the accumulator until a selected over-pressure has been applied. Release of pressure in the casing may cause flow through vibrator 67 in the reverse direction if the vibrator allows two-way flow. If it does not, fluid pressure in chamber 68 may be relieved through a by-pass channel around vibrator 66 having a one-way check valve (not shown), allowing piston 67 to return to stop 67A. Fishing neck 61 operates a mechanism to retract locking dogs 63 from a receiving groove and cups 62A after use of the vibration source has been completed, using methods well known in the wireline retrievable tool industry. Materials used to form apparatus 60 may be selected to allow apparatus or parts of apparatus 60 to be drilled from the casing or released such that it can be moved to a location that will not interfere with further operations in the well.

Figure 7:
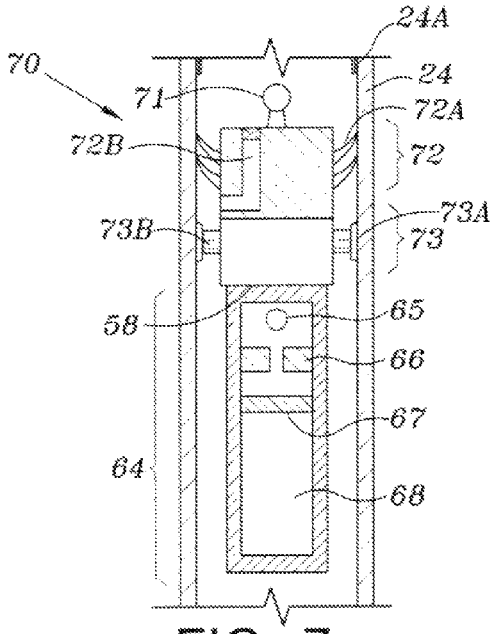
FIG. 7 illustrates a device that may be pumped down casing, used to apply impulses to the casing when locked to the casing by a mechanism in the device, and retrieved from the casing after use.

FIG. 7 illustrates a different locking mechanism from that illustrated in FIGS. 5 and 6. All other components of device 70 may be the same as illustrated in FIG. 5 or 6 (FIG. 6 is illustrated). Locking mechanism 73 may be battery-powered and may contain a sensor to detect marker 24A at a location previously selected inside casing 24. Marker 24A may provide a mechanical, electrical, magnetic, radioactive or other form of signal to be detected by locking mechanism 73. Casing 24 is standard casing, not containing grooves, such as shown in FIG. 2. The marker may be placed in the casing before running or may be placed after the casing is run, such as by wireline. When a selected marker is detected, slips 73A are quickly released to contact the inside surface of casing 24. Arms 73B then are activated to set slips 73A to resist high axial forces. Slips such as employed in packers may be used. After device 70 has been mechanically coupled to casing 24, bypass 72B will be opened by bursting a disc in the bypass as described above. When impact or vibration operations are complete, upward force on fishing neck 71 causes slips 73A to retract for removal of device 70 from the casing. Materials used to form apparatus 70 may be selected to allow apparatus or parts of apparatus 70 to be drilled from the casing or released such that it can be moved to a location that will not interfere with further operations in the well.

Figure 9:
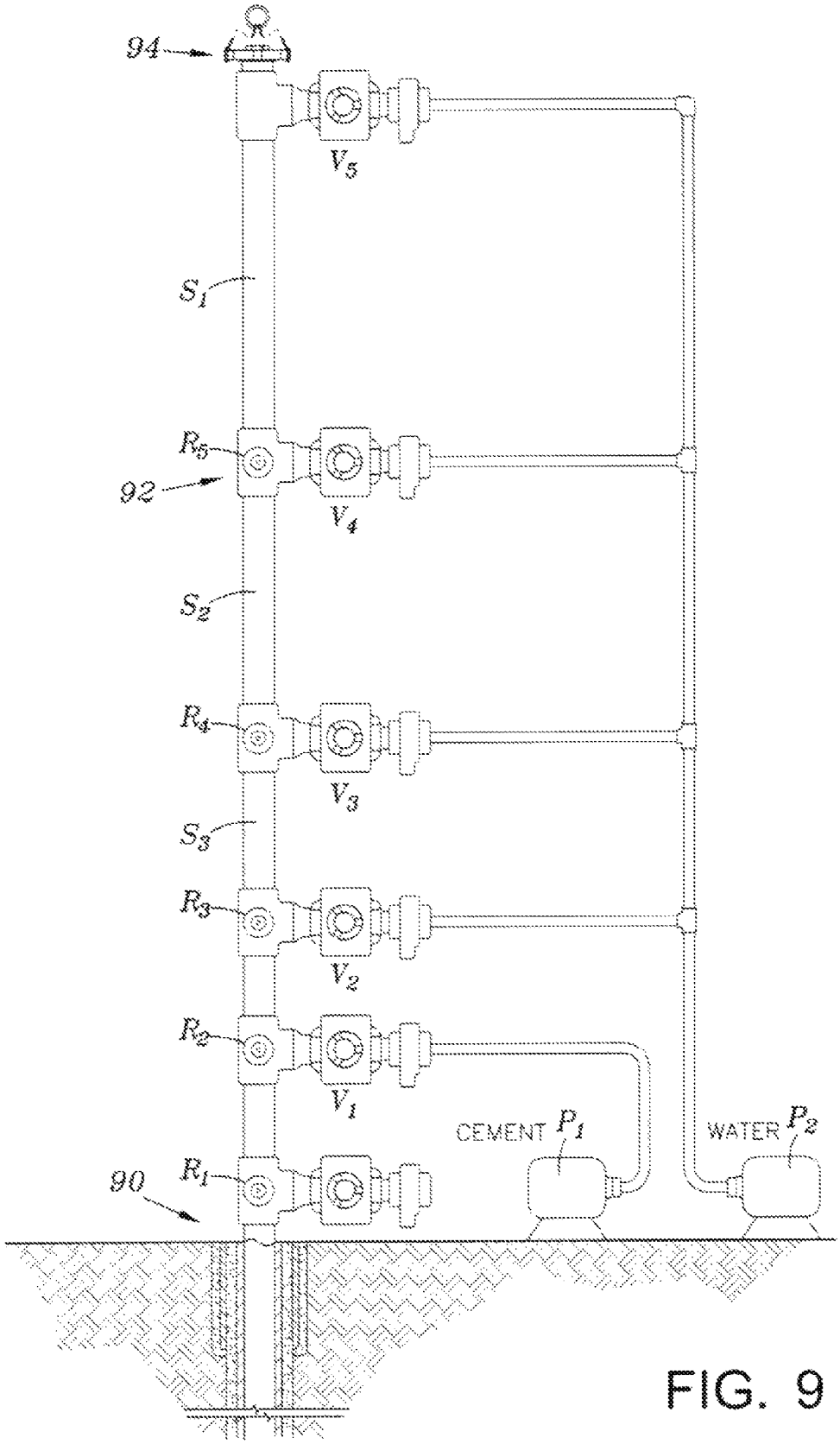
FIG. 9 illustrates one embodiment of surface apparatus for launching cement plugs and apparatus for applying impulses or vibrations to casing.

FIG. 9 illustrates surface apparatus for placing cement in a well with shock or vibration sources being deployed during pumping of the cement slurry. Well 90 may have casing such as casing 34 of FIG. 3, casing 34 having receiving grooves 31, 32 and 33. The bottom cement plug, top cement plug and three impact or vibration sources are loaded into extended cement head 92 by removing cap 94. The number of sources loaded may be from one to any selected number. With drilling fluid or other fluid in the well, the bottom cement plug is released into the casing by removing $R_1$ and opening $V_1$. Pump $P_1$ pumps the cement. Pressure in the cement is increased until a diaphragm is broken within the bottom plug, using normal procedures. After cement slurry has been pumped into the well, valve $V_2$ is opened and the top plug is released, as commonly practiced in industry. As the top plug is being pumped to the casing shoe, when less than the volume between the top plug and the lowest receiving groove has been pumped, vibration source $S_3$ is released, using the same procedure as used to release cement plugs. When Source $S_3$ has latched into the lowest receiving groove, continued pumping of displacement fluid ruptures the diaphragm in the source. Other sources to be placed into the well are released no later than at appropriate calculated volumes so that each source is latched into its designated receiving groove before the pumping of cement ends. The sources may be released earlier, in which case they will latch into its designated groove sooner before pumping ends.

Alternatively, the plugs and impact or vibration sources may be launched from a radial launcher, such that the total length of the launcher is less than that of FIG. 9 and may be better adapted to fit in limited space of a drilling rig. Various configurations may be used to provide for displacing a plug or impact or vibration source from a storage position on the surface to the casing, with or without interrupting flow of the displacement fluid. Mechanisms for launching the impact or vibration sources from within a pressurized container connected with the casing may be used.

Alternatively, it may be preferable to place the impact or vibration sources in the casing during or after cement pumping without rubber cups such as 52A, 62A or 72A. The apparatus may fall by force of gravity until it is locked to the casing. Fluid flow area around the sources and weight of the sources may be selected to attain a suitable fall velocity with or without flow of fluid downward in the casing.

With sources of impact in place, pressure inside casing 34 is increased to a value selected to activate all the impact sources, which are set to activate at about the same surface pressure in the casing. Preferably, the rate of increase of pressure inside the casing is rapid, to assist in applying the impacts near simultaneously. All impact sources preferably activate within a time span of about 5 minutes, more preferably within a time span of 3 minutes and most preferably within a time span of 1 minute. All time spans less than the time for the cement to re-form a gel structure to its original value after the structure is broken are defined herein as "near simultaneous." The time spans for the cement to re-form a gel structure after the structure is broken may be measured for the cement of interest and at well conditions using the methods described in the November 1988 paper referenced above and reported in FIG. 5 of that paper. Alternatively, the time spans may be measured using common cement rheology instruments for measuring gel strength. Simultaneous impulses from the different sources are transmitted through the cement sheath to reduce gel strength in the entire column of cement, or in enough of the cement column to cause the entire column of cement to move, at least down to the depth in the well where the process disclosed herein is to be applied. A sufficient number of sources are used such that the gel strength in the cement column is reduced to a point that the column can move to compensate for reductions in the volume of the cement slurry. The top of the cement column in the annulus drops as the impulses are transmitted through the annulus, and this drop may be measured using common instruments. Alternatively, a pressure at the top of the annulus containing the cement column may be measured, and a drop in pressure may be used to determine if the cement column is moving. Measurement of the compressibility of the measuring system (volume change per pressure change) will allow the volume of cement moved from the top of the cement column to be measured. Repeated increase and decrease in the casing pressure is preferably continued until the cement has hardened or set to the extent that fluid entering the cement will not channel upward through the annulus. This time will depend on the composition of the cement and the conditions in the well. Cement set times are one of the designed criteria in constructing a well. Times from 3 hours to 15 hours are in the normal range of set times. Alternate pressure increase and decrease to apply impulse to the cement column may continue for the entire set time or may be ended earlier if tests show that decrease in height of the cement column has sufficiently compensated for the decrease in volume of the cement slurry.

Other methods of triggering impacts and multiple locations in the casing may be used. For example a coded series of pressure pulses may be used to activate a chemical reaction, which creates a pressure in a device and releases an impact source. Devices such as described above may be energized by changes in casing pressure and activated by sound pulses sent down the casing of fluid in the casing. Preferably the forces of impact will be designed to activate near simultaneously at all locations along the casing. Preferably the first impacts in the casing will be applied shortly after cement pumping ends, i.e., shortly after bumping the plug.

After the impulse sources have been activated for the desired time, a wireline can be lowered into the well and latched on to the fishing neck of each device and the devices can successively be withdrawn from the well for re-use. Electric wireline, slick line, swab line or coiled tubing may be used. A lubricator may be used for the line. As explained above, expendable apparatus may also be used.

The use of vibration or impulses to break the gel strength in cement has been primarily discussed herein, but it should be understood that the methods and apparatus disclosed may be used with other methods for increasing pressure in curing cement. It has long been recognized that applying pressure at the surface of a cement column in an annulus can sometimes be helpful in preventing annular fluid flow. The limitation of this method is that fracture gradient in the wellbore often prevents application of enough pressure to be effective in moving a cement column. However, at times application of pressure at the surface can increase pressure in cement, as observed, for example, in the August 1983 paper referenced above (see FIG. 4 of that paper). Application of surface pressure in the annulus along with vibration or impacts in the casing, as disclosed herein, can provide benefits greater than the use of either method alone. Of course, selection of the composition of the cement slurry is important. A slurry that has low fluid loss, low gel strength until it sets and that has a gel structure easily broken and slow to re-form will still be beneficial to the process disclosed herein, but these properties are not required for success of the methods and apparatus disclosed herein.

When all the factors that control pressure in a cement column are considered, the pressure in the cement column as a function of time can be predicted based on gel strength of cement in the range of each source of impact or vibration, gel strength outside the range of a source, pressure applied at the surface of the cement column and its density, fluid loss rate from the cement column and shrinkage in volume of the cement slurry as a function of time after pumping. Whether fluid enters the wellbore will depend on whether pressure in the cement column is maintained above the pore pressure in any permeable zone intersecting the cement column long enough for the cement to build sufficient strength to exclude fluid at the pore pressure.

Although the present invention has been described with respect to specific details, it is not intended that such details should be regarded as limitations on the scope of the invention, except to the extent that they are included in the accompanying claims.

I claim:

1. A method for cementing a casing in a well, comprising:

during or after pumping of cement into an annulus outside the casing, placing inside the casing and above the cement in the casing an apparatus for applying an impulse or vibration to the casing and pumping down the apparatus in the casing to a selected location in the casing;

mechanically coupling the apparatus to the casing at the selected location; and activating the apparatus to apply an impulse or vibration to the casing.

2. The method of claim 1 wherein the apparatus is a jar and the jar is energized by increasing pressure in the casing.

3. The method of claim 1 wherein the apparatus is a vibrator or hammer connected to an accumulator wherein the accumulator receives fluid flowing through the apparatus and the apparatus is energized by an increase of pressure in the casing.

4. The method of claim 1 further comprising applying a fluid pressure above the cement in the annulus while activating the apparatus in the casing.

5. A method for cementing a casing in a well, comprising:

during placement of cement in an annulus outside the casing, pumping down with a displacement fluid inside the casing a plurality of apparatuses for applying an impulse or vibration to the casing and mechanically coupling the apparatuses to the casing at spaced apart locations; and after placement of the cement, activating the apparatuses within a selected time interval by pumping fluid into the casing.

6. The method of claim 5 wherein the apparatuses are mechanically coupled to the casing by spring-loaded members that extend into a groove in the casing.

7. The method of claim 5 wherein the apparatuses are mechanically coupled to the casing by slips pressed against the casing.

8. The method of claim 5 wherein the apparatuses are mechanically coupled to the casing at selected locations by a locking mechanism that activates when a marker is sensed and forces a slip against the casing surface.

9. A device for supplying an impulse or vibration to a casing during cementing of the casing, comprising:

a locking section for mechanically coupling the device to the casing;

an impulse or vibration source connected to the locking section; and wherein the locking section comprises locking dogs adapted for sliding inside the casing and locking into a recessed groove; and a fishing neck, the fishing neck being connected so as to release the locking section when an upward force is applied to the fishing neck.

10. The device of claim 9 wherein the impulse or vibration source is a jar.

11. The device of claim 9 wherein the impulse or vibration source is a vibrator or hammer activated by fluid flow through the vibrator or hammer and wherein the device further comprises an accumulator for receiving fluid flowing through the vibrator or hammer.

12. The device of claim 9 further comprising a placement section connected to the locking section.

13. A method for selecting method and apparatus to cement a casing in a well and controlling fluid entry into a cement column in an annulus outside the casing after pumping of a cement slurry, comprising:

predicting the amplitude of casing movement as a function of axial distance along the casing from an impact or vibration source to be placed in the well;

predicting the effect of the predicted casing movement on gel strength of the cement slurry in the annulus;

predicting the pressure along the cement column considering gel strength affected by and not affected by an impact or vibration source, cement properties and any applied pressure at the surface;

comparing the pressure along the cement column to expected pore pressures in the well; and selecting an impact or vibration source and method of use to maintain pressure in the cement column above pore pressures in the well for a selected time after pumping of the cement.

14. A device for supplying an impulse or vibration to a casing during cementing of the casing, comprising:

a locking section for mechanically coupling the device to the casing;

an impulse or vibration source connected to the locking section;

wherein the locking section comprises locking dogs adapted for sliding inside the casing and locking into a recessed groove; and wherein the impulse or vibration source is a vibrator or hammer activated by fluid flow through the vibrator or hammer and wherein the device further comprises an accumulator for receiving fluid flowing through the vibrator or hammer.

* * * * *